US006938631B2

(12) United States Patent
Gridley

(10) Patent No.: US 6,938,631 B2
(45) Date of Patent: Sep. 6, 2005

(54) VENTILATOR FOR COVERS FOR BOATS AND OTHER VEHICLES

(76) Inventor: William E. Gridley, W. 314 S. 4151 Highway 83, Waukesha, WI (US) 53189

( * ) Notice: Subject to any disclaimer, the term of this patent is extended or adjusted under 35 U.S.C. 154(b) by 92 days.

(21) Appl. No.: 10/461,002

(22) Filed: Jun. 13, 2003

(65) Prior Publication Data

US 2003/0230330 A1 Dec. 18, 2003

Related U.S. Application Data

(60) Provisional application No. 60/389,165, filed on Jun. 17, 2002.

(51) Int. Cl.[7] ..... E04H 15/16; F24F 13/20

(52) U.S. Cl. ..... 135/94; 135/114; 135/33.7; 135/135; 454/368; 454/250; 454/237

(58) Field of Search ..... 52/198, 199; 454/367, 454/368, 237, 241, 242, 243, 250; 135/91, 93, 94, 114, 135, 905, 33.7, 88.09

(56) References Cited

U.S. PATENT DOCUMENTS 2,953,145 A * 9/1960 Moss et al. ..... 135/98
3,054,413 A * 9/1962 Eshelman ..... 135/123
3,953,955 A * 5/1976 Huddle ..... 52/745.08
4,148,332 A * 4/1979 Huddle ..... 135/123
4,219,036 A * 8/1980 Biggs ..... 135/93
4,379,468 A 4/1983 Szukhent ..... 135/88.01
4,397,225 A * 8/1983 Patton ..... 454/368
4,538,508 A * 9/1985 Ballard ..... 454/361
6,102,794 A * 8/2000 Cline ..... 454/368
6,196,915 B1 * 3/2001 Schiedegger et al. ..... 454/339

* cited by examiner

*Primary Examiner*—Anita King
*Assistant Examiner*—Jon Szumny
(74) *Attorney, Agent, or Firm*—Richard M. Saccocio

(57) ABSTRACT

A ventilator for a covering for a boat or other object includes a dome for covering air venting openings. The air vents are provided in a pair of oppositely disposed ventilator plates. The boat or other covering is firmly clamped between the ventilator plates by means of a nut that can be tightened by hand. The venting openings are disposed one above the other with no obstructions therebetween in order to allow for direct air transfer between the inside and the outside of the cover while preventing weather elements from entering the cover.

13 Claims, 4 Drawing Sheets

VENTILATOR FOR COVERS FOR BOATS AND OTHER VEHICLES

CROSS REFERENCE TO RELATED APPLICATIONS

This application is related to U.S. Provisional Patent Application Ser. No. 60/389,165, filed Jun. 17, 2002.

BACKGROUND OF THE INVENTION

1. Field of the Invention

This invention relates in general to the field of ventilator apparatus and in particular to ventilator apparatus adapted to be used with a non-porous covering for a boat or any other object that is located out of doors and protected from the elements by the non-porous covering.

2. Description of the Prior Art

Recreational vehicles such as boats and travel trailers are typically stored outdoors when not in use. Often, a cover is placed over the entire vehicle in order to protect it from elements of the weather such as rain, snow, sleet, ultraviolet rays, heat from direct sunlight, as well as dirt and dust from the outside air. In this regard, a simple cover is quite effective and yet an inexpensive alternative to indoor storage. In the prior art, the covers can comprise canvas, plastic and other generally non-porous materials. Obviously, a non-porous cover functions very well for its intended purpose. Neither dirt nor rain can penetrate the non-porous material and as a result the recreational vehicle is fairly well protected when not in use.

In the more recent prior art, vehicle covers have become available that prevent rain and dirt from entering the fabric while air is able to pass through the fabric. This type of prior art cover is said to "breath" and thereby prevent a problem associated with all prior art covers. The problem being condensation forming inside the cover from a temperature difference between the inner and outer surfaces of the cover. In a completely non porous cover, the condensation, in the form of moisture, is trapped inside the cover where it can penetrate every unsealed surface of the covered vehicle and every electrical, mechanical and fabric component in the vehicle. In a very real sense, the trapped moisture is more damaging than the vehicle being left uncovered. An uncovered vehicle can dry out, but a covered vehicle with moisture trapped therewithin does not dry out and the vehicle is constantly exposed to the moisture which over a shortened period of time can cause a significant amount of damage. The newer, breathable prior art materials allow some of the trapped moisture to escape, but not completely. Even with the breathable materials, moisture remains trapped inside the cover for a longer period of time than it would if the cover were removed and the vehicle allowed to air dry. It is to be noted that the moisture problem is not necessarily exclusive to the outdoors. Indeed, indoor storage, for example, where the air is not conditioned or otherwise dry, can experience high humidity. In such an environment, the moist air can damage a covered object or vehicle by becoming trapped under the cover.

The solution to the above stated problem is, of course, to ventilate the cover so that air can freely pass in and out of the space inside of the cover a ventilation device is a virtual requirement for non-porous covers and is advantageous when used with the newer prior art breathable materials because of their tendency to trap moisture, albeit to a lower degree than the non-porous materials. Ventilation devices are known in the prior art and are all effective to a degree.

However, a better, more efficient, inexpensive, and easy to install ventilation device is always more desirable. The present invention is directed to such a ventilation device. The prior art contains not stored indoors are typically protected by a canvas or similar non-porous material. The present invention provides, among other things, a ventilator that effectively allows the passage or air between the interior and exterior surfaces of a cover made from either a breathable or a non-porous material, while not allowing precipitation such as rain, snow, and sleet to pass between the interior and exterior surfaces of the cover. And, as noted, the present invention serves a useful purpose even when the covered object is located indoors.

SUMMARY OF THE INVENTION

The above-stated objects as well as other objects which, although not specifically stated, but are intended to be included within the scope the present invention, are accomplished by the present invention and will become apparent from the hereinafter set forth Detailed Description of the Invention, Drawings, and the Claims appended herewith.

The inventive ventilation device comprises a component assembly including a dome member, an upper ventilator plate, a lower ventilator plate and a nut that are all made from a molded plastic. No metal screws or a scratch awl are required to install the inventive apparatus. The inventive ventilation apparatus can, if desired, be used with a pole to raise the cover up and away from the vehicle surface to enhance the circulation of air. A simple hole of a predetermined size is made in the cover material. The dome member with the upper ventilator plate already attached thereto is fitted into the hole in the cover. Then the lower ventilator plate is fitted from underneath the cover onto the shaft extending through the hole in the cover and the nut is threaded onto the shaft. Tightening of the nut is done by hand and when fully tightened the top and bottom ventilator plates are snugged up against each other and against the dome with the cover material firmly clasped between the ventilator plates. Ventilating air is allowed to pass freely through the ventilator plates by aligned openings provided in the plates. The dome piece prevents the elements from being introduced through the openings in the ventilator plates.

In accordance with the above, there has been summarized the more important features of the present invention in order that the detailed description of the invention as it appears in the below detailed description of the same, may be better understood.

BRIEF DESCRIPTION OF THE DRAWINGS

Various other objects, advantages, and features of the invention will become apparent to those skilled in the art from the following discussion taken in conjunction with the following drawings, in which.

DESCRIPTION OF THE PREFERRED EMBODIMENTS

Figure 1:
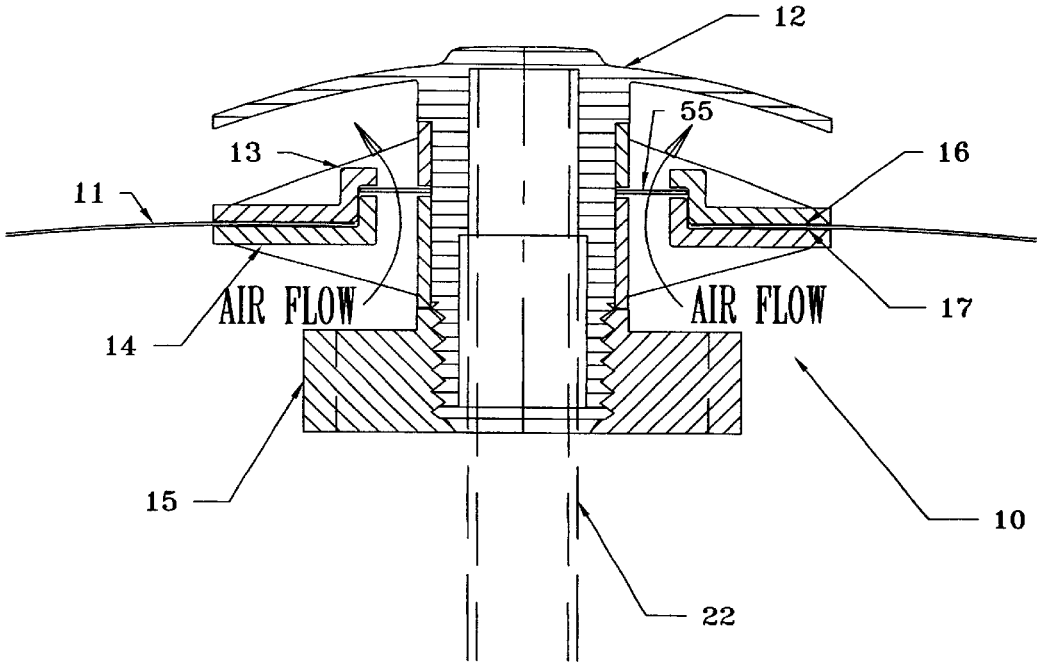
FIG. 1 is a front plan view, in cross section, of one embodiment of the present invention as it may appear in practice attached to a vehicle cover.

As required, detailed embodiments of the present invention are disclosed herein; however, it is to be understood that the disclosed embodiments are merely exemplary of the invention which may be embodied in various forms. Therefore, specific structural and functioning details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like the characteristics and features of the present invention shown in the various figures are designated by the same reference numerals.

In the illustrated embodiment of FIG., the inventive ventilator 10 can be generally envisioned to include an outer portion and an inner portion. The outer portion is generally that portion of the inventive ventilator 10 that is located on the top or exterior side of the cover 11 and includes a portion of the dome member 12 and the upper ventilator plate 13. The inner portion is generally that portion of the inventive ventilator 10 that is located on the under side or interior side of the cover 11 and includes a portion of the dome member 12, the lower ventilator plate 14, and the securing nut 15. Thus, the dome piece or member 12 is common to the outer and inner portions of the inventive ventilator 10. In the assembled view shown in FIG. 1, the cover material 11 is seen to include a hole there through with a main portion of the cover material 11 extending radially away from the hole and clamped between the opposed surfaces 16 and 17, of the upper ventilator plate 13 and the lower ventilator plate 14, respectively.

Figure 2:
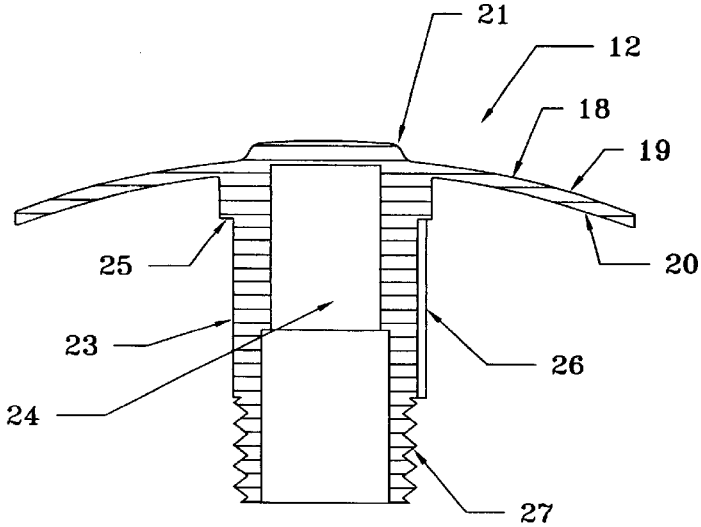
FIG. 2 is a front plan cross sectional view of the dome portion of the embodiment shown in FIG. 1.

Details of the dome member 12 are shown in FIG. 2 which generally comprises a dome portion and a shaft portion. Dome portion comprises a circular plate 18 having a curved umbrella like configuration such that the axial center is the uppermost portion and the outer surface curves in a downward direction as it extends away from the axial center. By way of further explanation, the upper surface 19 of the dome portion has a convex configuration while the under surface 20 has a concave configuration. The dome 12 serves in general to prevent rain and other elements from entering the cover through the air vents provided with the ventilation apparatus 10 and therefore the domed configuration aids in this function by placing the outer edges of the dome on a plane substantially level, or slightly lower or higher then the air vents. The outer diameter of the plate member 18 of the dome 12 is preferably, but not necessarily equal to the outer diameter of the ventilator plates 13 and 14. Accordingly, the shape of the dome 12 and its outer diameter is to be consistent with its intended function and is well within the knowledge of a person of ordinary skill in this art The inventive ventilator 10 contemplates that the plate member 18 can be flat and still function but not as efficiently as the illustrated and preferred curved configuration.

The slightly thicker center portion 21 of the plate member 18 is provided to furnish extra strength to the dome in the event that a pole 22 (shown in phantom in FIG. 1) is used to raise the cover 11 up and off of the covered vehicle or other device being protected by cover 11. Of course, the plate member 18 can be made sufficiently thick so that the center portion 21 has the same thickness as the plate member 18 in general. Further alternatives include that the plate member can be of a variable thickness and that it have other than a circular configuration.

Dome member 12 includes a shaft 23 that extends downwardly from the center of plate member 18. Plate member 18 and shaft member 23 actually comprise a single member, i.e. the dome 12. Shaft member 23 includes a blind axial opening 24 sized to accept a stand-off pole 22 (see FIG.). Blind hole 24 can be of a single diameter or of stepped, multiple diameters to accept poles of different diameters. The outer diameter of shaft 23 includes a first diameter and a second smaller diameter with a step or flanged surface 25 there between, one or more axial keys 26 extending along the length of the second smaller diameter of shaft 23, and screw threads 27 at the bottom of the second smaller diameter, each of which can be integrally molded with the shaft 23. The function and characteristics of these features of shaft 23 are further described below.

Figure 3:
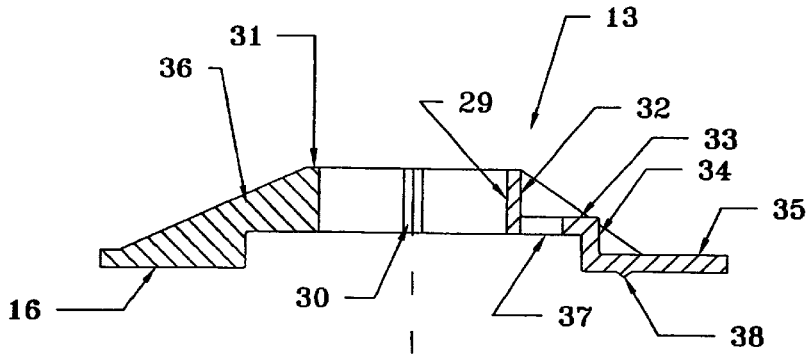
FIG. 3 is a front plan cross sectional view of the upper ventilator plate of the embodiment shown in FIG. 1 and taken along the line 3—3 of FIG. 4.
Figure 4:
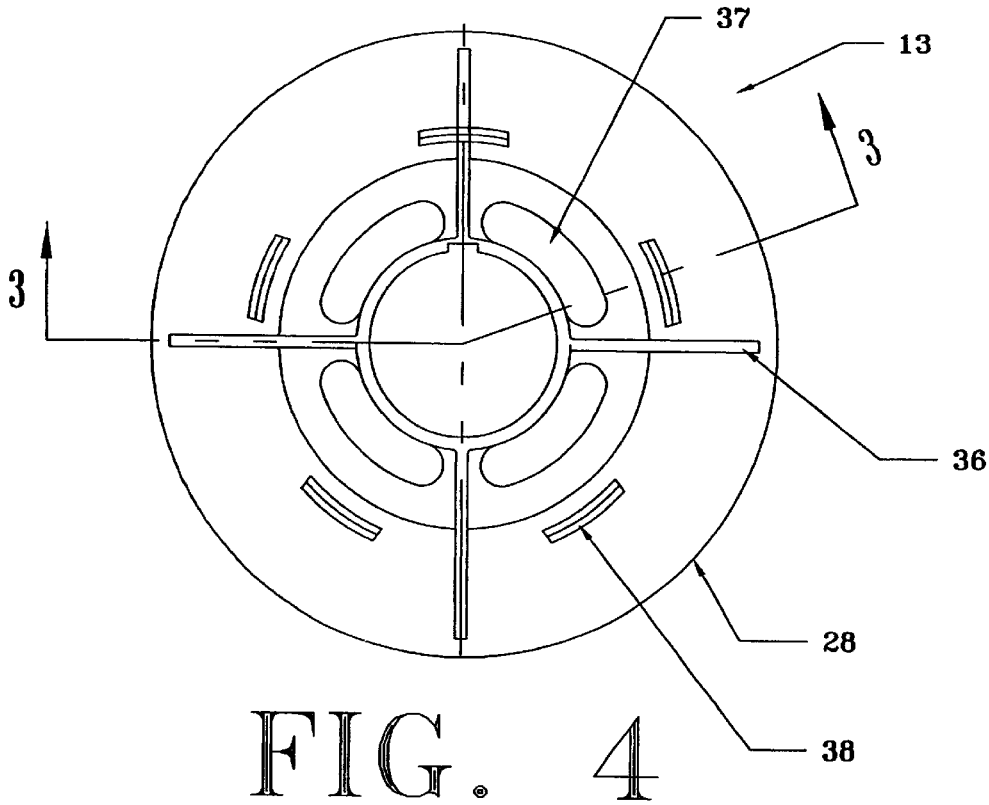
FIG. 4 is a top plan view of the ventilator plate of FIG. 3.

The upper ventilator plate 13, shown in FIGS. 3 and 4, comprises an air venting plate member having a generally circular outer diameter 28 and a circular opening 29 axially through the center thereof. Circular opening 29 is sized to fit therewithin the axial portion of shaft 23 immediately below the step 25. One or more axial keyways 30 are provided within the opening 29 each being configured to accept and engage a respective one of the one or more keys 26 of shaft 23 in order to align and prevent rotation of the upper ventilator plate 13 relative to shaft 23. The annular surface 31 on the top of the upper ventilator plate is intended to fit against the step or flange surface 25 of shaft 23 and thereby fix the axial position of upper ventilator plate 13 relative to shaft 23. Preferably, but not necessarily, upper ventilator plate 13 is glued or otherwise fixed to the shaft 23, but alternatively can be press fitted, fastened, or integrally formed with the shaft 23 to maintain the upper ventilator plate's position with respect to the dome member 18. As a further alternative, the present invention 10 contemplates that the dome member 12 and the upper plate member can be made as a single member. The upper ventilator plate 13 also includes an outer diameter substantially the same as that of the dome member 18, a first axial portion 32 (within which is located circular opening 29), a first flat plate portion 33 extending radial outward from the bottom of the first axial portion 32, a second axial portion 34 extending downward from the outer diameter of the first flat plate portion 33, and a second flat plate portion 35 extending radially outward from the bottom of the second axial portion 34 of the upper ventilator plate 13

A plurality of strengthening ribs 36 extend radially outward from the first axial portion 32 to the second flat plate portion 35 along the upper surface of ventilator plate 13 connecting and reinforcing the flat 33 and the axial 34 portions there between. A plurality of air venting openings 37 are provided in the first flat plate portion 33. The plurality of venting openings 37 are integrally formed with the first flat plate portion 33 and are oriented with respect to the keyway 30. In order to positively clamp the outer covering 11 between the ventilator plates 13 and 14, a plurality of mating ridges and grooves can be used. Accordingly, FIGS. 3 and 4 show a plurality of circumferential clamping ridges 38 extending around the bottom surface 16 of the second flat plate portion 35 for mating contact with a plurality of circumferential grooves discussed below.

The bottom surface 16 of the upper ventilator plate 13 can be provided with a roughened or irregular surface finish for the purpose of further aiding in clamping and sealing the cover 11 between the ventilator plates 13 and 14. Referring also to FIG. 1, a screen member 55 can be fitted within the inner diameter of the second axial portion 34 and up against the lower horizontal surface of the first plate portion 33 of ventilator 13 so as to screeningly cover the air vent holes 37 of ventilator 13. The ostensible purpose of screen 54 being, for example, to prevent small living creatures from gaining entrance to the inside of the cover 11.

Figure 5:
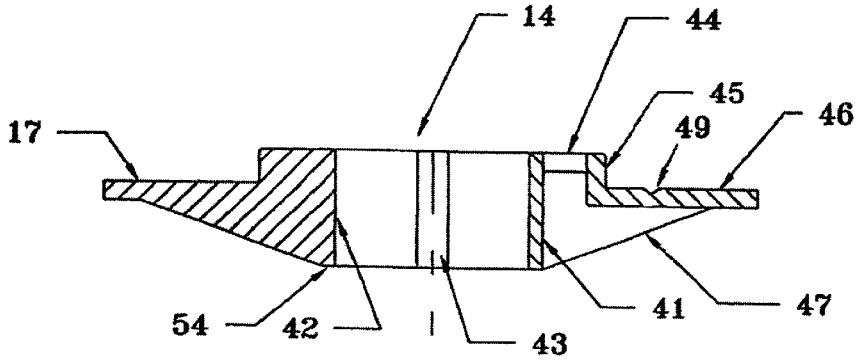
FIG. 5 is a front plan cross sectional view of the lower ventilator plate of the embodiment shown in FIG. 1 and taken along the line 5—5 of FIG. 6.
Figure 6:
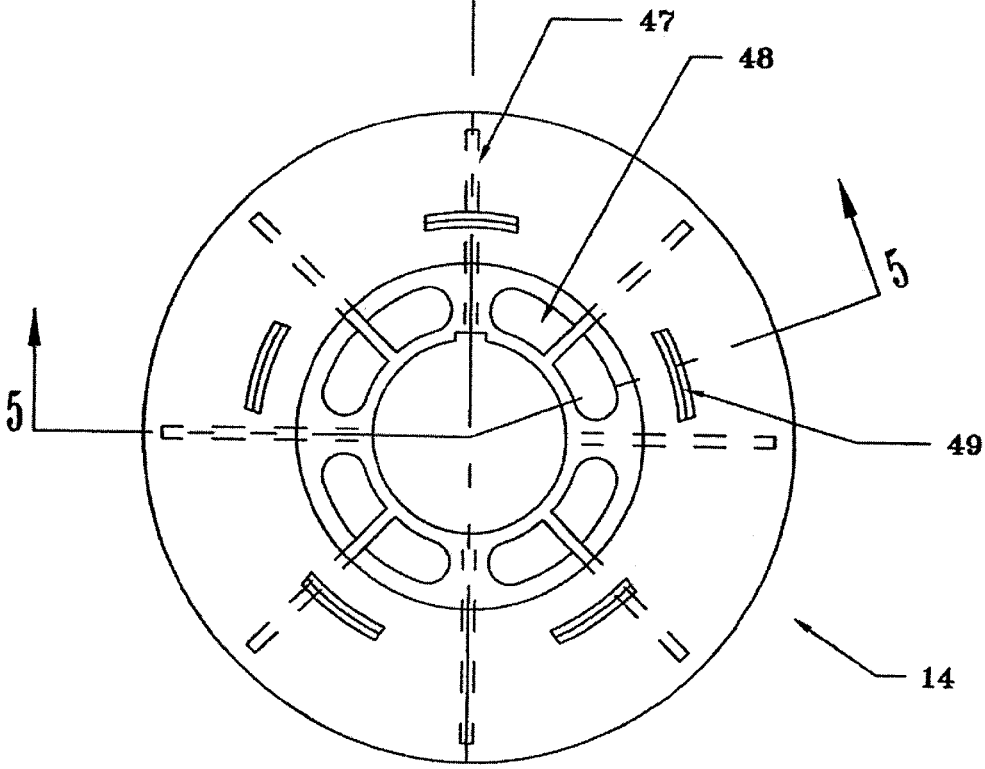
FIG. 6 is a top plan view of the ventilator plate of FIG. 5.

The lower ventilator plate 14, illustrated in FIGS. 5 and 6, is configured to fit on shaft 23 and to mate with the upper ventilator plate 13. A first axial portion 41 of the lower ventilator plate 14 includes an opening 42 there through that is sized to accept the second smaller outer diameter of shaft 23. One or more axial keyways 43 are provided within the opening 42 that are configured to accept and engage the one or more keys 26 of shaft 23 to align and prevent rotation of the lower ventilator plate 14 relative to shaft 23 and relative to the upper ventilator plate 13. A first flat plate portion 44 of the lower ventilator plate 14 extends radially outward from the top end of the first axial portion 41. A second axial portion 45 of the lower ventilator plate 14 extends downward from the outer diameter of the first flat plate portion 44 of the lower ventilator plate 14. A second flat plate portion 46 of the lower ventilator plate 14 extends radially outward from the lower end of the second axial portion 45 of the lower ventilator plate 14.

A plurality of strengthening ribs 47 extend radially outward from the first axial portion 41 to the second flat plate portion 46 along the lower surface of ventilator plate 14 connecting and reinforcing the flat 44 and the axial 45 portions there between. A plurality of air venting openings 48 are provided in the first flat plate portion 44. The plurality of venting openings 48 are integrally formed with the first flat plate portion 44 and are oriented with respect to the keyway 43. A plurality of circumferential clamping grooves 49 extend around the upper surface of the second flat plate portion 46 for mating contact with the plurality of circumferential ribs 38 on upper ventilator plate 13. That is, that the ridges 38 fit within the grooves 49. The upper surface 17 of the ventilator 15 can also be provided with a roughened or irregular surface finish for the purpose of further aiding in clamping and sealing the cover 11 between the ventilator plates 13 and 14.

When the lower ventilator plate 14 is assembled to the shaft 23 of the dome member 12, the one or more keyways 43 orient the lower ventilator member 14 with the upper ventilator plate 13 such that the air venting openings 37 and 38 are aligned with each other and the clamping ridges 38 and grooves 49 are also aligned with each other. It is to be noted that ridges 38 and grooves 49 can be located at any convenient location on plates 13 and 14 and can extend around the respective plates in a full circle.

Figure 7:
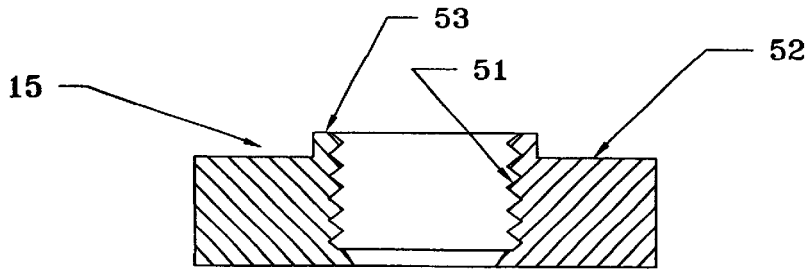
FIG. 7 is a plan cross sectional view of the nut of the embodiment shown in FIG. 1 taken along the line 7—7 of FIG. 8; and, FIG. 8 is a top plan view of the nut of FIG. 7.
Figure 8:
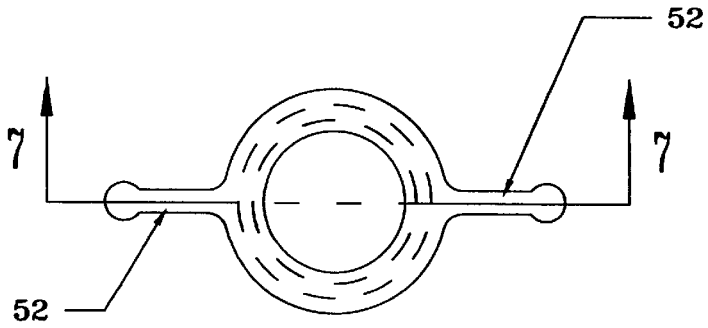

FIGS. 7 and 8 illustrate a fastening device that is used to secure the lower ventilator plate 14 to the dome member 12 (the upper ventilator plate 13 having already been assembled to the dome member 12 or being integrally formed therewith). The fastening member 15 can comprise a nut-like member having an internal screw thread 51 sized to mate with the external threads 27 at the bottom of shaft 23. A number of alternative attaching means can be used in place of the illustrated screw threads. For example, a pin in association with a camming slot, a lever operated cam lock, and other like attaching means as are known in the art. In the illustrated embodiment, a pair of oppositely disposed wings 52 extend from the outer diameter of the fastening member 15 to permit hand assembly of the fastening member 15 to the shaft 23 and to tighten the lower ventilator plate 14 up against the upper ventilator plate 13. A hexagonal configuration can alternatively be used in lieu of wings 52. The tightening accomplished by a top annular surface 53 of the fastening member 51 bearing against an annular surface 54 located at the bottom of the first axial portion 41 of the lower ventilator plate 14 when the fastening member 51 is rotated.

To install the ventilator in a cover 11, a substantially circular hole is cut through or otherwise formed in the cover 11, the diameter of the hole being substantially equal to or slightly greater than the outer diameter of the second axial portion 45 of the lower ventilator plate 14. The dome member 12 (with the upper ventilator plate 13 assembled or attached thereto) is inserted through the hole in the cover 11. Not essential to the invention, but advantageous to the life of the cover 11, the inventor has found that a reinforcing, donut shaped ring member made from the cover material can be used between the plates 13 and 14 to provide a double thickness of cover material at the clamping location of the vent 10. Then the lower ventilator plate 14 is fitted to the shaft 23 of the dome member 12 with the one or more keyways 43 being aligned with the one or more keys 26 so as to align the air vent holes 37 and 48 and to align the clamping ridges 38 and grooves 49. When the lower ventilator plate 14 is fully or substantially seated up against the upper ventilator plate 13, with the cover 11 there between, the second axial portion 45 of the lower ventilator plate 14 is inserted within the second axial portion 34 of the upper ventilator plate 13. The fastening member 15 is then assembled to the shaft 23 and tightened whereby the cover 11 is clamped between the lower surface of the upper ventilator plate 13 and the upper surface of the lower ventilator plate 14 and the cover 11 is further clamped between the clamping ridges 38 and grooves 49. Since the hole in the cover is larger that the outside diameter of the second axial portion 45 of the lower ventilator plate 14, the cover 11 does not interfere or otherwise cover the aligned venting openings 37 and 48 and air is permitted to freely pass from the inside of the cover 11, through the aligned vents 37 and 48, and to the outside of the cover 11. When in use, the dome member 12 covers the plurality of venting openings such that any precipitation is deflected away from the venting openings. As a result, the precipitation can not enter the cover by going through the air vents provided in the inventive ventilator 10.

If the venting application requires supports to prop the cover, then the supports can simply be inserted in the opening 24 in shaft 23 of the ventilator to prop the cover. The Supports can be used to prop the cover such that rain, sleet, snow, etc. does not settle in a low spot of the cover, which may cause deterioration of the cover or other damage.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breach and scope of the claims here appended.

I claim as my invention:

1. A ventilator adapted to be used with a protective cover for a boat or other object comprising:

a dome member including an attached shaft extending downward therefrom;

a first ventilator plate having one or more ventilating openings therethrough, said first ventilator plate being fitted on said shaft;

a second ventilator plate member having one or more ventilating openings therethrough, said second ventilator plate being fitted on said shaft and relative to said first ventilator plate such that said one or more ventilating openings are substantially coincident with each other; and a fastening member to axially clamp said first and second plates to said shaft.

2. The ventilator of claim 1 including said first ventilator plate comprising:

a first axial portion having an axial opening therethrough, a first flat plate portion extending radially outward from a bottom of the first axial portion, a second axial portion extending downward from an outer diameter of the first flat plate portion and a second flat plate portion extending radially outward from a bottom of the second axial portion.

3. The ventilator of claim 2, wherein said one or more ventilating openings are located in said first flat plate portion.

4. The ventilator of claim 1, including said second ventilator plate comprising:

a first axial portion having an axial opening therethrough, a first flat plate portion extending radially outward from a top end of the first axial portion, a second axial portion extending downward from an outer diameter of the first flat plate portion, and a second flat plate portion extending radially outward from a lower end of the second axial portion.

5. The ventilator of claim 4, wherein said one or more ventilating openings are located in said first flat plate portion.

6. The ventilator of claim 1, including one or more keys fitted to an outside diameter of said shaft, one or more keyways in said first plate member and one or more keyways in said second plate member, said one or more keys being fitted in said one or more keyways in said plate members.

7. The ventilator of claim 1, including one or more ridges on one of said ventilator plates and one or more grooves on an other one of said ventilator plates, each of said one or more ridges being respectively fitted within each of said one or more grooves.

8. The ventilator of claim 1 including one or more strengthening ribs on each of said ventilator plates.

9. The ventilator of claim 1, including a lower surface of said first ventilator and an upper surface of said second ventilator plate each having a non-smooth surface.

10. The ventilator of claim 1, wherein said fastening member comprises a nut having internal screw threads and said shaft includes external screw threads.

11. The ventilator of claim 1, including a stepped surface on said shaft with an upper surface of said first ventilator being fitted up against said stepped surface.

12. The ventilator of claim 1, wherein said dome member includes a curved surface extending radially outward from an axial center of said shaft, said curved surface being convex on an upper side and concave on a lower side thereof, said curved surface being axially spaced from an upper end of said first ventilator plate.

13. A ventilator adapted to be used with a protective cover for a boat or other object comprising:

a dome member including a curved plate portion and an attached shaft extending downward therefrom, said shaft having a first outer diameter and a second outer diameter with a step therebetween, a key member axially positioned on said second outer diameter of said shaft, a lower end of said shaft having screw threads thereon;

a first ventilator plate having one or more ventilating openings therethrough, said first ventilator plate including an inside diameter having a first keyway therein, said first ventilator plate being fitted onto said shaft with said key being positioned within said first keyway, and an upper surface of said first ventilator plate being fitted against said step;

a second ventilator plate member having one or more ventilating openings therethrough, said second ventilator plate including an inside diameter having a second keyway therein, said second ventilator plate being fitted onto said shaft with said key being positioned within said second keyway and relative to said first ventilator plate such that said one or more ventilating openings are substantially coincident with each other;

said protective cover having a hole therethrough and being clamped outside of said hole between a lower surface of said first ventilator plate and an upper surface of said lower ventilator plate; and a fastening member screwed onto said shaft whereby said cover is firmly clamped between said ventilator plates with said ventilating openings being in registry and allow for flow communication between an inside and an outside of said cover.

* * * * *